United States Patent [19]

Chielens et al.

[11] 3,981,350

[45] Sept. 21, 1976

[54] APPARATUS FOR SUPPORTING AND COOLING A CONTINUOUSLY CAST PRODUCT

[75] Inventors: Alain Chielens, Marcq en Baroeul; Jean Pierre Henin, Lille, both of France

[73] Assignee: Fives-Cail Babcock, Paris, France

[22] Filed: Mar. 10, 1975

[21] Appl. No.: 556,878

[30] Foreign Application Priority Data

Mar. 8, 1974 France ..... 74.07923

[52] U.S. Cl. ..... 164/283 R; 193/38; 432/121

[51] Int. Cl.[2] ..... B22D 11/14; B65G 11/18; F27B 3/12

[58] Field of Search ..... 164/283 R, 283 S, 283 M, 164/283 MS, 283 MT, 276, 128, 263, 273, 282, 82, 83, 266–269, 73, 89; 266/4 S, 6 S, 21; 134/64 R, 122 R, 125; 193/38, 41; 432/85, 121, 122

[56] References Cited

UNITED STATES PATENTS

| | | | |
|---|---|---|---|
| 1,880,146 | 9/1932 | Morison | 266/21 |
| 2,418,386 | 4/1947 | Wood | 134/122 X |
| 2,708,107 | 5/1955 | Holcroft | 266/21 UX |
| 3,399,716 | 9/1968 | Rossi | 164/128 X |
| 3,515,202 | 6/1970 | Bick | 164/89 |
| 3,559,967 | 2/1971 | Werner | 266/21 X |
| 3,623,536 | 11/1971 | Moritz | 164/89 |
| 3,638,928 | 2/1972 | Mitchell | 266/21 X |
| 3,681,853 | 8/1972 | Reid | 432/121 X |
| 3,688,833 | 9/1972 | Bykov | 164/283 S |
| 3,753,459 | 8/1973 | Burkhardt | 164/283 S X |
| 3,774,671 | 11/1973 | Rossi | 164/282 |
| 3,800,855 | 4/1974 | Bashkov et al. | 164/282 X |

*Primary Examiner*—Francis S. Husar
*Assistant Examiner*—John S. Brown
*Attorney, Agent, or Firm*—Kurt Kelman

[57] ABSTRACT

Continuously cast metal, such as steel, ingots are supported and cooled while being displaced along a path on a panel comprised of alternating support bars and cooling fluid spray banks extending parallel to each other transversely to the path of displacement. The spray banks are mounted individually and removably on the panel.

24 Claims, 20 Drawing Figures

APPARATUS FOR SUPPORTING AND COOLING A CONTINUOUSLY CAST PRODUCT

The present invention relates to installations for the continuous casting of metals having a high melting point, such as steel, and more particularly to an apparatus for supporting, guiding and cooling the continuously cast products displaced along a path while they are solidified.

Generally, continuously cast metal products are supported on a series of horizontally extending rollers while they are cooled by jets of water from nozzles or banks of cooling fluid sprays placed between the rollers. In such an arrangement, the portion of the surface of the cast product reached by the cooling fluid is only a fraction of the surface between the lines of contact between two adjacent rollers and the product passing thereover. This is particularly true for the zone immediately adjacent the casting apparatus where the solidified skin of the product is very thin and the support rollers are very close to each other. This makes it necessary either to increase the length of the installation, which correspondingly increases its cost, or to reduce the velocity of displacement of the cast product, which reduces the productivity.

It has been proposed to replace the rollers by plates over which the cast product glides and to cool the gliding product, at the level of the plates, by means of water injected under pressure between the plates and the surface of the product. However, since this surface has irregularities, the cooling is not uniform because the water flows more fully in certain channels. Furthermore, the plates are rapidly worn and must frequently be replaced, which is complicated and costly, particularly in installations for the production of large ingots requiring relatively heavy support plates.

It has also been suggested to use grids instead of plates for supporting the cast product and to cool the products by means of water jets projected through the openings in the grid. Such monolithic grids are relatively heavy and, therefore, difficult to manipulate and costly to replace.

It is accordingly a primary object of this invention to provide apparatus for supporting and cooling a continuously cast product, which if free of the inconveniences of the prior art and which is constituted by a series of identical elements of light weight and easy to replace.

The above and other objects are accomplished in accordance with the invention with a series of support bars extending substantially parallel to each other in a direction transverse to the path of displacement of the cast product. The support bars are assembled to form a panel and each bar includes a portion of rectangular cross section having a large face and a small face. The large face extends perpendicularly to the surface of the cast product and the small face is arranged in contact with the surface of the cast product to support the product. The width of the small faces of the bar portions is substantially less than the spacing between the bar portions. Means for spraying a cooling fluid are disposed substantially parallel to each other on the panel and between the support bars.

Since the smaller support faces are considerably narrower than their spacing from each other, the heat exchange zones between the hot cast product and the support bars are limited and the zones which are not cooled by the cooling fluid are reduced. The distance between the cooling fluid spray means and their spacing from the surface of the cast product are such that the cooling fluid jets totally cover the free surface of the cast product between the support bars.

The above and other objects, advantages and features of the present invention will become more apparent from the following detailed description of certain now preferred embodiments thereof, taken in conjunction with the accompanying drawing wherein FIG. 1 is a side elevational view of a support and cooling panel for a continuously cast ingot according to one embodiment of this invention;

Figure 1:
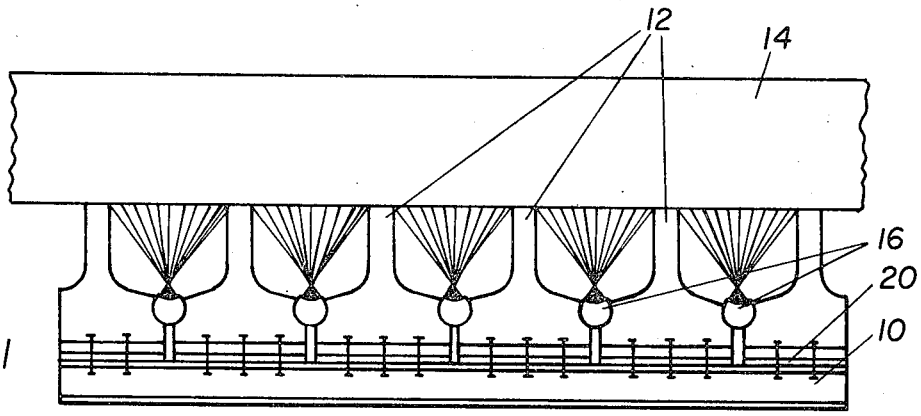
Figure 19:
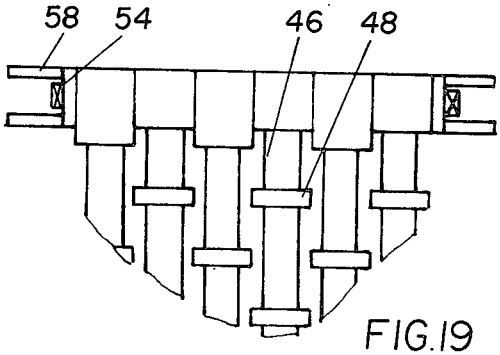
Figure 20:
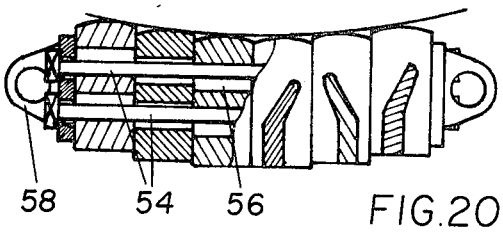

FIG. 19 is a partial plan view of a panel showing a manner of assembling the support bars; and FIG. 20 is a cross section of FIG. 19. Referring now to the drawing and first to FIGS. 1 and 2, the support and cooling panel is constituted by two elongated beams 10, 10 extending in the direction of the path along which continuously cast product 14 is displaced and on which are mounted support bars 12 extending substantially parallel to each other in a direction transverse to the path of displacement. The support bars are inverted T-bars whose base portions are affixed to the bars are inverted T-bars support frame while their narrow portions are of rectangular cross section having a large face and a small face. As is shown in FIG. 1, the large faces of support bars 12 extend perpendicularly to the surface of cast product 14 and the small face is arranged in contact with this surface to guide and support the product. The width of the small support faces is substantially less than the spacing between the upwardly extending narrow bar portions.

Any suitable means are used to mount the support bars on the support frame or beams for ready dismounting and replacement.

Figure 2:
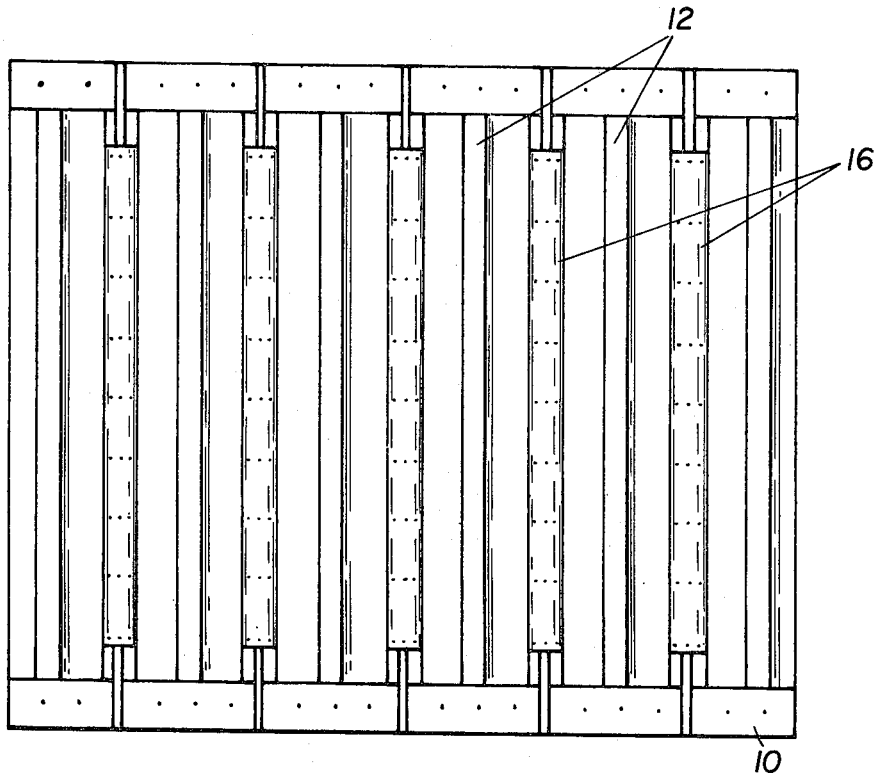
FIG. 2 is a top plan view of the panel of FIG. 1.

Means 16 for spraying a cooling fluid, such as water, are disposed substantially parallel to each other on the panel and between support bars 12, the illustrated cooling fluid spray means being constituted by banks of spray nozzles for atomizing the water. As shown in FIG. 2, the banks of nozzles are so arranged that cooling fluid jets are produced along their entire length so as to reach the entire free surface of the cast product between the support bars.

Figure 3:
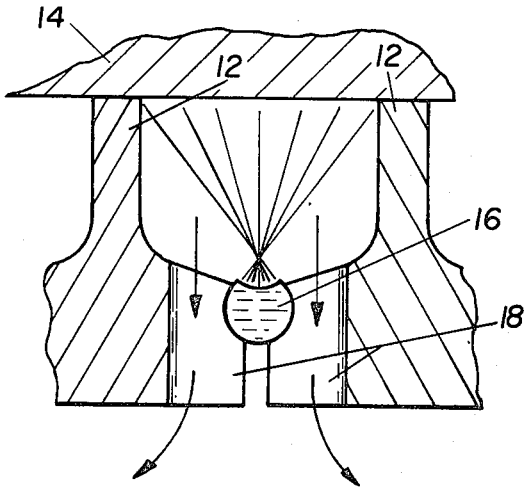
FIG. 3 is an enlarged transverse section showing a detail of panel of FIG. 1.
Figure 4:
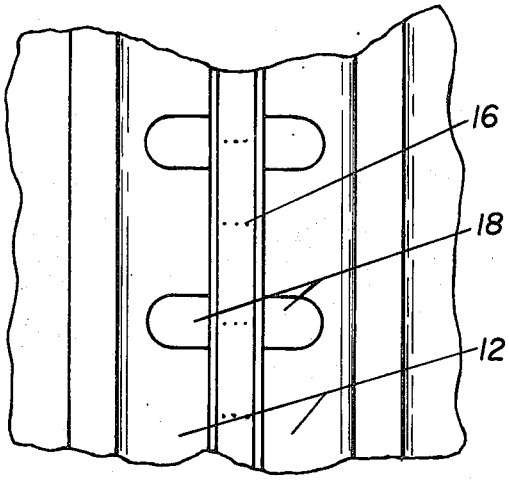
FIG. 4 is a top plane view of FIG. 3.

In the embodiment illustrated in FIGS. 3 and 4, the bases of the T-bars from ribs extending therefrom in the direction of the path of displacement of the cast product and banks 16 of the spray nozzles are carried in longitudinal seats formed by aligned recesses in the ribs. In this manner, the banks of spray nozzles may be readily removed and replaced from the assembly. The banks of spray nozzles are supplied by cooling water and, if desired, air through a suitable supply conduit system.

In a continuous casting installation, at least two panels of this type will be placed face to face to support and cool the two surfaces of the cast product while the product is displaced and guided therebetween in a direction perpendicular to the support bars and spray means. The number of panels used will depend, of course, on their dimension and the characteristics of the installation. If desired, these support and cooling panels may be associated with conventional guide systems, such as rollers, plates or grids.

In the illustrated embodiment, all the support bars are in the same plane and assure a rectilinear guidance for the cast product. In the case of curved castings, the positioning of the support bars must be adapted to the profile of the casting. In this case, the shape of the support frame or beams 10 is given a suitable form and/or chocks 20 mount the support bars on the frame or beam in the desired positions. The panel is mounted on the frame of the casting installation.

Figure 5:
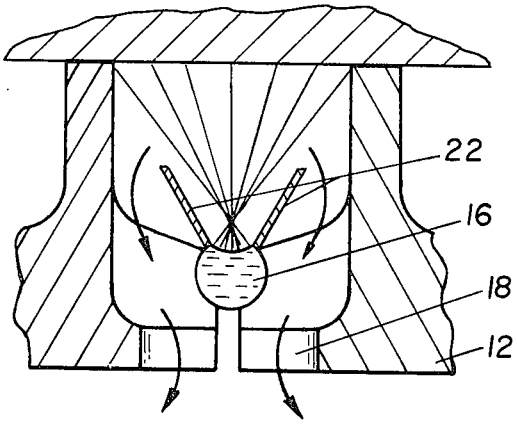
FIGS. 5, 6 and 7 are views analogous to FIG. 3 but showing modifications of this embodiment.
Figure 6:
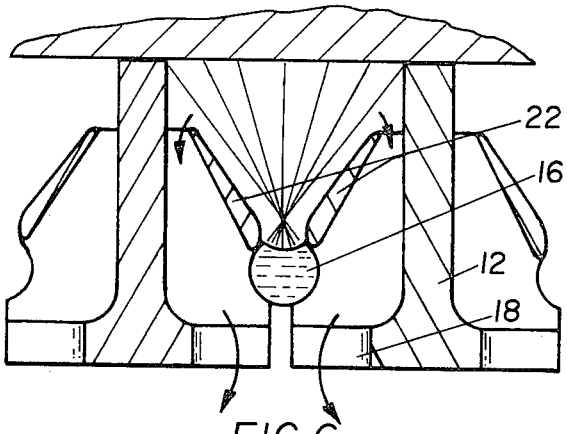

Cooling will be improved by rationalizing the circulation of the cooling fluid and of the vapors produced by the spent fluid. As shown in FIGS. 5 and 6, this may be accomplished by providing two divergent deflectors 22, 22 disposed on respective sides of spraying banks 16 and dividing the space between two support bars 12 into a central zone wherein the cooling fluid enters and two lateral zones wherethrough vapors from the spent cooling fluid are evacuated. These deflectors permit the cooling fluid to be brought under a slight superpressure, particularly when a mixture of air and atomized water is used, and to increase the speed of evacuation of the water vapor produced when the water spray contacts the hot surface of the cast product. As shown by the arrows in FIGS. 5 and 6, the vapor is evactated through ports 18 in the ribs or bases of the support bars.

In the embodiment of FIG. 5, deflectors 22 are affixed to spray means 16. In FIG. 6, they are affixed to, or integral with, support bars 12 and form a monolithic block therewith.

Figure 7:
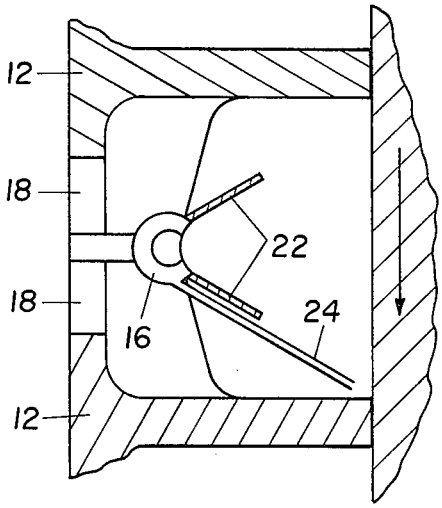

FIG. 7 shows an embodiment for facilitating the evacuation of non-evaporated cooling fluid. In this embodiment, several small diameter tubes 24 extend from each bank of spray nozzles and are directed towards the leading edge of the small support faces of support bars 12, in the direction of displacement of the cast product indicated by the arrow in FIG. 7. In this case, the main of the bank of spray nozzles is double-walled to form a first conduit for delivering cooling water to the nozzles and an annular chamber for delivering compressed air to small diameter tubes 24. The compressed air jets emanating from the tubes displace any excess liquid from the leading edges of the support bars.

Figure 10:
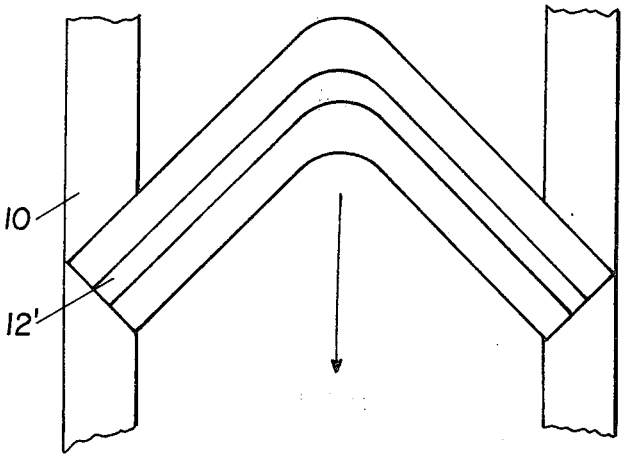
FIG. 10 illustrates another embodiment of the support bar and spraying means.

For the same purpose and as shown in FIG. 10, rectilinear support bars 12 may be replaced by V-shaped bars 12', the point of the V being directed upstream in the path of displacement (see arrow) of the cast product. In this case the banks 16 of spray nozzles (now shown in FIG. 10), will also be V-shaped, being constituted, for instance, by two spray banks placed end to end.

While the support bars and spray banks have been shown to extend perpendicularly to the path of displacement of the cast product in FIGS. 1 and 2, they may also be arranged obliquely in a direction transverse to this path. The latter arrangement has the advantage of facilitating the evacuation of the cooling fluid, as in the V-shaped arrangement of FIG. 10.

Figure 8:
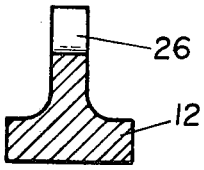
FIG. 8 is a cross section showing a detail of the support bar of the panel.
Figure 9:
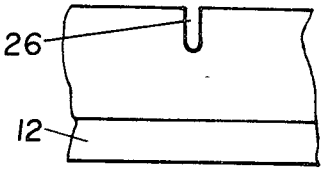
FIG. 9 is a side elevation of FIG. 8.

As shown in the embodiment of FIGS. 8 and 9, perpendicular or biased grooves 26 may be formed in the small support faces of support bars 12 to limit the strains in the support faces due to differences in the thermal expansion of the bar portions in contact with the hot product as compared with the rest of the support bars.

Figure 11:
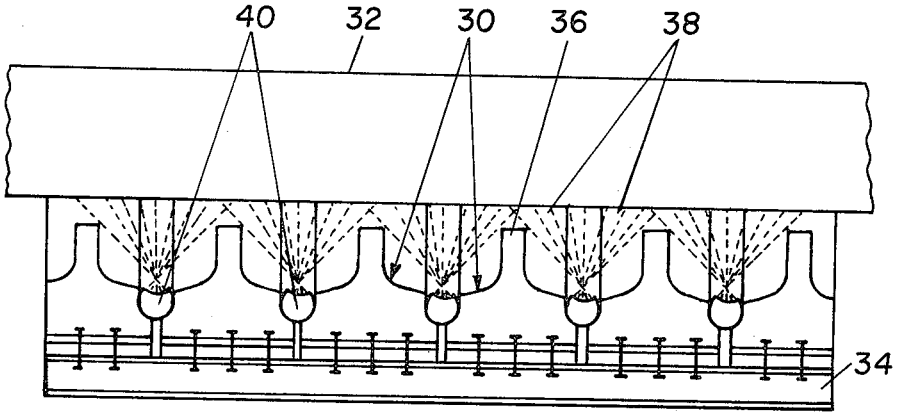
FIGS. 11 and 12 are analogous to FIGS. 1 and 2, and show another embodiment of the apparatus.
Figure 12:
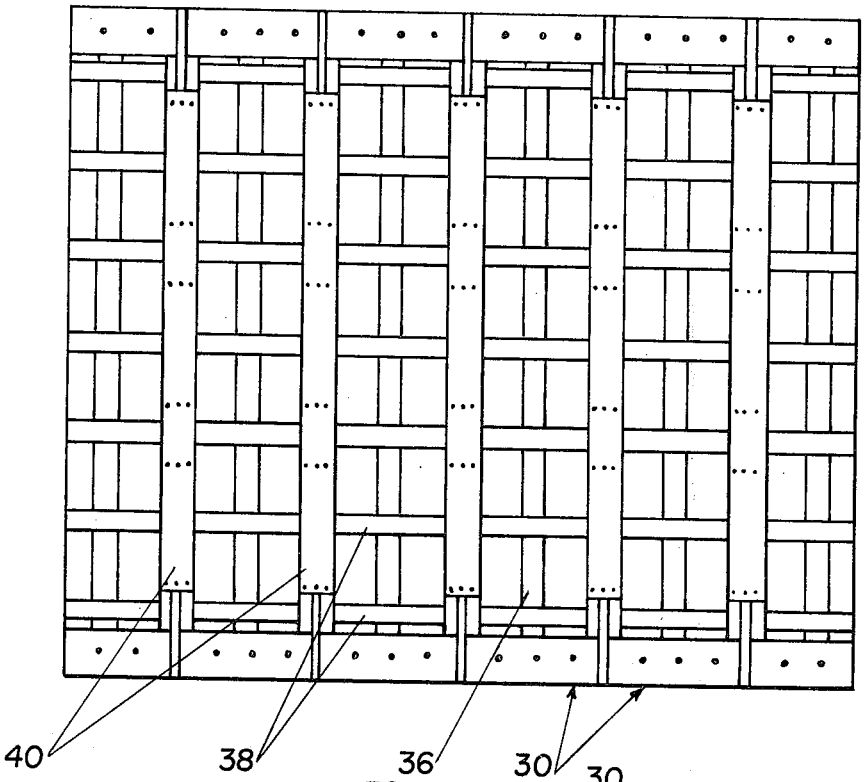

In the embodiment of FIGS. 11 and 12, the support and cooling panel is constituted by a series of T-shaped support bars 30 disposed perpendicularly to the path of displacement of case product 32 and mounted at their ends by means of screws, bolts or like removable fastening means on support frame 34, thus permitting the bars to be removed and replaced rapidly and easily. As in the previously described embodiment, each bar has a central, longitudinally extending portion 36 of rectangular cross section. In this embodiment, a series of transverse ribs 38 are regularly spaced along the entire length of support bar portion 36 and these ribs extend in the direction of the path of displacement of the cast product. The height of the ribs exceeds that of bar portion 36 so that the cast product is supported soley on the ribs whose top faces constitute rectangular support faces for product 32 whose largest dimension is parallel to the path of displacement of the product. As can be seen from FIG. 12, the width of the small faces is substantially less than the spacing between them.

Figure 13:
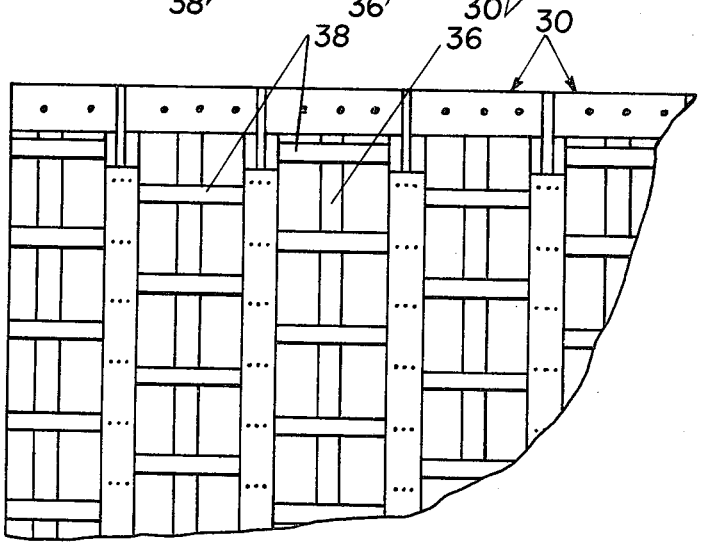
FIG. 13 is a partial plan view showing a modification of the apparatus of FIGS. 11 and 12.

In the embodiment of FIG. 12, all the ribs 38 of support bars 30 are aligned. In the modification of FIG. 13, ribs 38 of adjacent support bars are set off from each other by a distance corresponding to half the spacing between the ribs so that the ribs of alternate support bars are in alignment. This disposition limits transverse curving between two ribs.

As in the embodiment of FIGS. 1 and 2, spray banks 40 are disposed between the support bars parallel thereto. They are supported in seats on the base portions of the bars and notches are provided in the edges of ribs 38 to enable the spray banks to pass therethrough.

Figure 14:
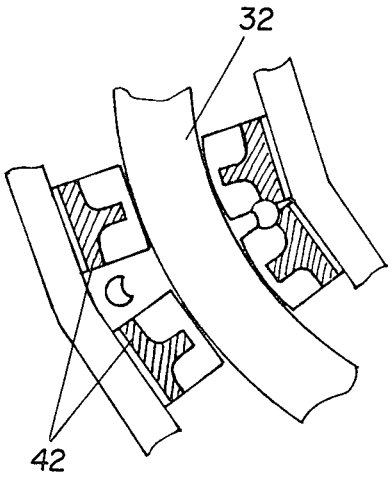
FIG. 14 is a transverse section of two support bars of two panels respectively supporting the two surfaces of an ingot.
Figure 15:
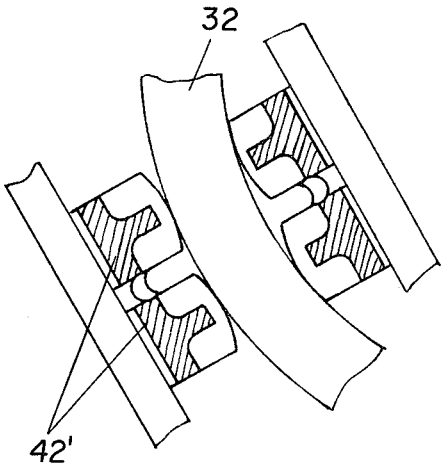
FIG. 15 is analogous to FIG. 14 and shows a modification of such an arrangement.

The small support surfaces for the cast product may be plane or they may be slightly curved in the direction of the path of displacement of the product. In the curved portions, they should be adapted to the curvature of the path of the cast product. Curved support faces are shown in FIGS. 14 and 15 wherein cast product 32 is guided between two support and cooling panels comprising, respectively, series of support bars 42 and 42'. In the embodiment of FIG. 14, the small support face of the support bar shown at the lower left is plane or flat while the support faces of the other support bars are convex. In FIG. 15, the small faces of all support bars 42' are convex.

The construction of the cooling and support panels will be simplified if the support bars for both panels are identical and interchangeable and the radius of curvature of the convex support faces is less than the radius of curvature of the path of the cast product. However, the radius of curvature of the small support faces must not be too small so as to present a contact surface of sufficient size for support and guidance of the cast product. If the radius of curvature of the support faces is judiciously chosen and the support panel is not too long in the direction of the path of displacement of the cast product, a plane support frame may be used for the support bars and their positioning on the support frame may be adjusted by means of chocks so that the support plane defined by the series of support faces corresponds to the theoretical profile of the cast product (see FIG. 15.). In this case, the contact zone between the cast product and the support faces on the ribs is slightly offset from the median plane of each support bar.

If deflectors are used, as shown in FIGS. 5 and 6, they may be constituted by webs positioned between the ribs on each support bar and integral therewith.

Figure 16:
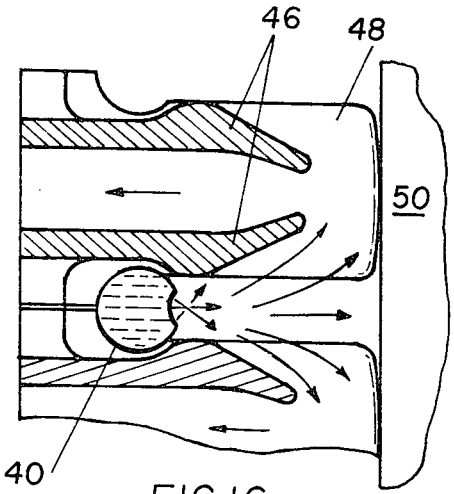
FIG. 16 is a transverse section showing another embodiment of the support bars.
Figure 17:
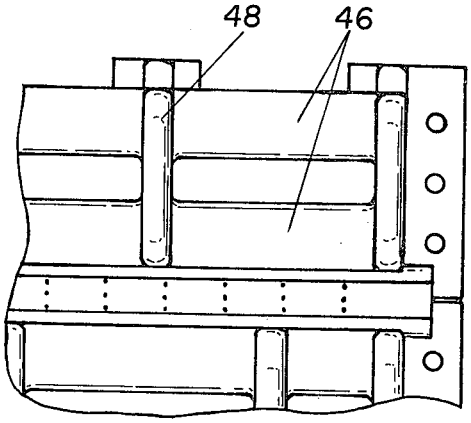
FIG. 17 is a partial plan view of the bars of FIG. 16.

In the embodiment of FIGS. 16 and 17, each support bar is formed by two elongate webs 46, 46 spaced from each other and interconnected by ribs 48 whose height exceeds that of the webs so as to support and guide cast product 50. As shown in FIG. 16, the two webs converge towards the support faces of ribs 48 without touching and thus constitute deflectors channelling the cooling fluid jets emitted by banks 40 of spray nozzles The passage defined by two adjacent ribs permit evacuation of vapors (see arrows in FIG. 16).

Figure 18:
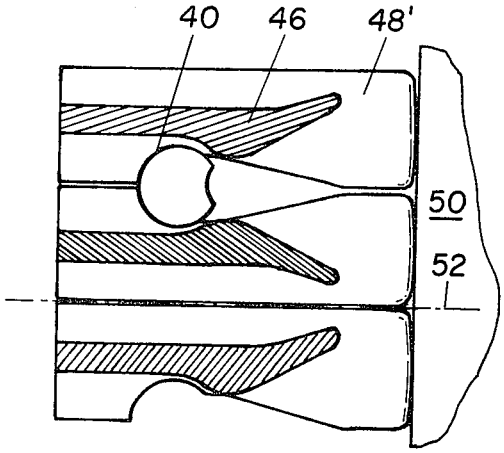
FIG. 18 is analogous to FIG. 16 showing yet another embodiment of the support bars.

FIG. 18 shows a modification of the latter embodiment wherein the ribs on each support bar consist of two identical halves disposed symmetrcally in respect of plane of symmetry 52. This simplifies the bar construction.

FIGS. 19 and 20 show another manner of assembling the support bars. Instead of affixing the bars to a support frame or beams, bars 46 are arranged in series and assembled by means of tie rods 54 passing through the ends of the support bars. Bores 56 in the bar ends are of sufficient diameter to permit the bars to be offset in respect of each other to permit the panel to be adapted to the curvature of the path of displacement of the cast product. Loops 58 are mounted at each end of the assembled panel to permit the panel to be mounted on the frame of the casting installation and to support the panel thereon.

While the support panels hereinabove described are designed to support the large surfaces of cast ingots, an analogous support system may be used for the small surfaces thereof, such support panels being applied to the small ingot surfaces by means of jacks or springs.

What is claimed is:

1. An apparatus for supporting and cooling a continuously cast product having a surface while the product is displaced along a path, comprising 1. a series of substantially identical support bars extending substantially parallel to each other in a direction transverse to the path of displacement,
   a. the support bars being dismountably assembled to form a panel, and
   b. each bar including a portion of rectangular cross section having a large face and a small face, the large face extending perpendicularly to the surface of the cast product and the small face being arranged in contact with the surface of the cast product to support the product, the width of the small faces of the bar portions being substantially less than the spacing therebetween; and
2. elongated means for spraying a cooling fluid disposed substantially parallel to each other on the panel and between the support bars, the elongated spraying means being supported by the panel.

2. The apparatus of claim 1, further comprising ribs extending from the support bars in the direction of the path, the cooling fluid spraying means being carried by the support bar ribs.

3. The apparatus of claim 2, wherein the support bar ribs define aligned recessed forming lingitudinal seats for the spraying means.

4. The apparatus of claim 1, further comprising two divergent deflectors, the deflectors being disposed on respective sides of the spraying means and dividing the space between two support bars into a central zone wherein the cooling fluid enters and two lateral zones wherethrough vapors from the spent cooling fluid are evacuated.

5. The apparatus of claim 4, wherein the deflectors are affixed to the support bars.

6. The apparatus of claim 1, wherein the support bars are inverted T-bars.

7. The apparatus of claim 1, wherein the support bars have base portions defining port means facilitating evacuation of vapors from spent cooling fluid.

8. The apparatus of claim 1, wherein the small support faces of the support bar portions have grooves formed therein.

9. The apparatus of claim 1, wherein the support bars and spraying means are V-shaped, the point of the V being directed upstream in the path of displacement of the cast product.

10. The apparatus of claim 1, further comprising small diameter tubes directed towards the leading edge of the small support faces of the support bar portions, in the direction of displacement of the cast product, and means for delivering compressed air to the tubes to remove liquid from the leading edges.

11. The apparatus of claim 10, wherein the means for delivering compressed air comprises a chamber extending the length of the spraying means and supplied with compressed air, and the small diameter tubes are mounted on the spraying means in communication with the chamber.

12. The apparatus of claim 1, wherein the small faces of the support bars extend in a direction transverse to the path of displacement of the cast product.

13. The apparatus of claim 1, wherein the small faces of the support bars extend in the direction of displacement of the cast product and a plurality of said small support faces are spaced along the length of each of said bars.

14. The apparatus of claim 13, wherein the spacing between the small support faces of each support bar is of the same order of magnitude as the spacing between the support bars.

15. The apparatus of claim 13, wherein the small support faces of the support bars are aligned.

16. The apparatus of claim 13, wherein the small support faces of the support bars are offset from each other in the direction of the displacement of the cast product.

17. The apparatus of claim 13, wherein each support bar has a portion extending in a direction transverse to the path of displacement of the cast product and a series of ribs extending transversely to said support bar portion, the height of the ribs exceeding the height of the support bar portion and the ribs having said small support faces.

18. The apparatus of claim 13, wherein each support bar is comprised of two elongate webs spaced from each other and interconnected by a series of ribs extending transversely to the webs, the height of the ribs exceeding the height of the webs and the ribs having said small support faces.

19. The apparatus of claim 18, wherein the webs converge towards a median plane of the support bar.

20. The apparatus of claim 1, wherein the small support faces are plane.

21. The apparatus of claim 1, wherein the small support faces are convex.

22. The apparatus of claim 21, arranged in a curved portion of the path of displacement of the cast product, the radius of curvature of the convex support faces being less than the radius of curvature of the curved path.

23. The apparatus of claim 1, wherein each support bar is formed by two identical halves disposed symmetrically in respect of a plane of symmetry.

24. The apparatus of claim 1, wherein the support bars are assembled in series and further comprising tie rod means passing through the ends of the assembled bars for forming the panel.

* * * * *